US005344033A

United States Patent [19]

Herman

[11] Patent Number: 5,344,033

[45] Date of Patent: Sep. 6, 1994

[54] PRODUCE STAND

[76] Inventor: Richard Herman, P.O. Box 1757, Hendersonville, N.C. 28739

[21] Appl. No.: 70,095

[22] Filed: May 28, 1993

[51] Int. Cl.[5] ..... A47F 5/00

[52] U.S. Cl. ..... 211/150; 211/127; 108/6

[58] Field of Search ..... 211/150, 127, 175, 170; 312/115, 116, 126, 136; 108/6, 8; 248/397

[56] References Cited

U.S. PATENT DOCUMENTS

| | | | |
|---|---|---|---|
| 40,647 | 11/1863 | Stackpole | 248/397 |
| 735,346 | 8/1903 | Dean | 211/170 |
| 1,283,326 | 10/1918 | Schreck | 211/175 |
| 1,409,856 | 3/1922 | Hill | 312/116 |
| 3,385,453 | 5/1968 | Pantino | 211/175 |
| 3,625,160 | 12/1971 | Bergman | 108/6 X |
| 3,872,800 | 3/1975 | Wallis et al. | 108/6 |
| 4,108,154 | 8/1978 | Nelson | 248/397 X |
| 4,295,623 | 10/1981 | Schweizer | 248/456 |
| 4,913,501 | 4/1990 | Swank | 312/120 X |

*Primary Examiner*—Robert W. Gibson, Jr.
*Attorney, Agent, or Firm*—Joseph T. Guy, Jr.

[57] ABSTRACT

An adjustable display rack is detailed which provides several advantages including ease of operation and stability. The adjustable display rack comprises a bottom frame, a bin pivotally mounted to the bottom frame, an adjustable support member connecting the rearward portion of the bottom frame and bin, optional legs, optional walls and optional drawers.

14 Claims, 6 Drawing Sheets

PRODUCE STAND

BACKGROUND OF THE INVENTION

This invention relates generally to an adjustable display rack for foodstuffs and the like. More specifically this invention relates to an adjustable display rack in which the angle can be easily adjusted for optimal display appearance.

Creative display of merchandise is important to the sales of items and merchandisers are constantly searching for improved methods of displaying their items. This is especially important in produce sales since a full rack is more attractive to a customer than a sparsely populated shelf, as known in the art.

Many display racks have been developed which aid in attempts to insure that the display appears full, as exemplified in U.S. Pat. No. 3,385,453, for example. While display racks of this type do lend the appearance of being full, any adjustment is difficult and often requires the attendant to remove the displayed items prior to adjusting the shelf. Another problem with the display racks currently known in the art is the inability to rigidly lock the shelf in place. As merchandise is removed, and replaced, the shelves can frequently be caused to fall potentially harming the contents.

There has been a long felt need in the art to provide an adjustable display rack which can be easily adjusted with merchandise still in the storage bin. There has also been a need to provide such a display rack which is sturdy and provides limited risk of moving due to removing and restocking merchandise.

SUMMARY OF THE INVENTION

It is an object of the present invention to provide an adjustable display rack which allows for easy adjustment of the angle of the display bin.

It is yet another object of the present invention to provide an adjustable display rack which is sturdy and capable of maintaining a predetermined position.

It is a further object of the present invention to provide an adjustable display rack which can be adjusted without removing the displayed items from the rack.

A particular feature of the present invention is the constant engagement of the adjustable support member with the bottom frame and the bin.

Yet another particular feature of the present invention is the ease with which the adjustment can be actuated and the minimal manipulation required to do so.

These and other advantages, as will be apparent from the description herein, are provided in an adjustable display rack comprising: a bottom frame comprising a front end and a rear end; a bin pivotally mounted to said front end of said bottom frame; at least one adjustable support rotatably mounted to said frame; wherein said adjustable support comprises: a tube; an elongated member slidably mounted to said tube; a locking element for reversibly fixing the position of said elongated member relative to said tube; a mounting bracket pivotally attached to one end of said elongated member; wherein said mounting bracket is rigidly attached to said bin.

DETAILED DESCRIPTION OF THE INVENTION

Throughout the following description similar elements are numbered accordingly.

Figure 1:
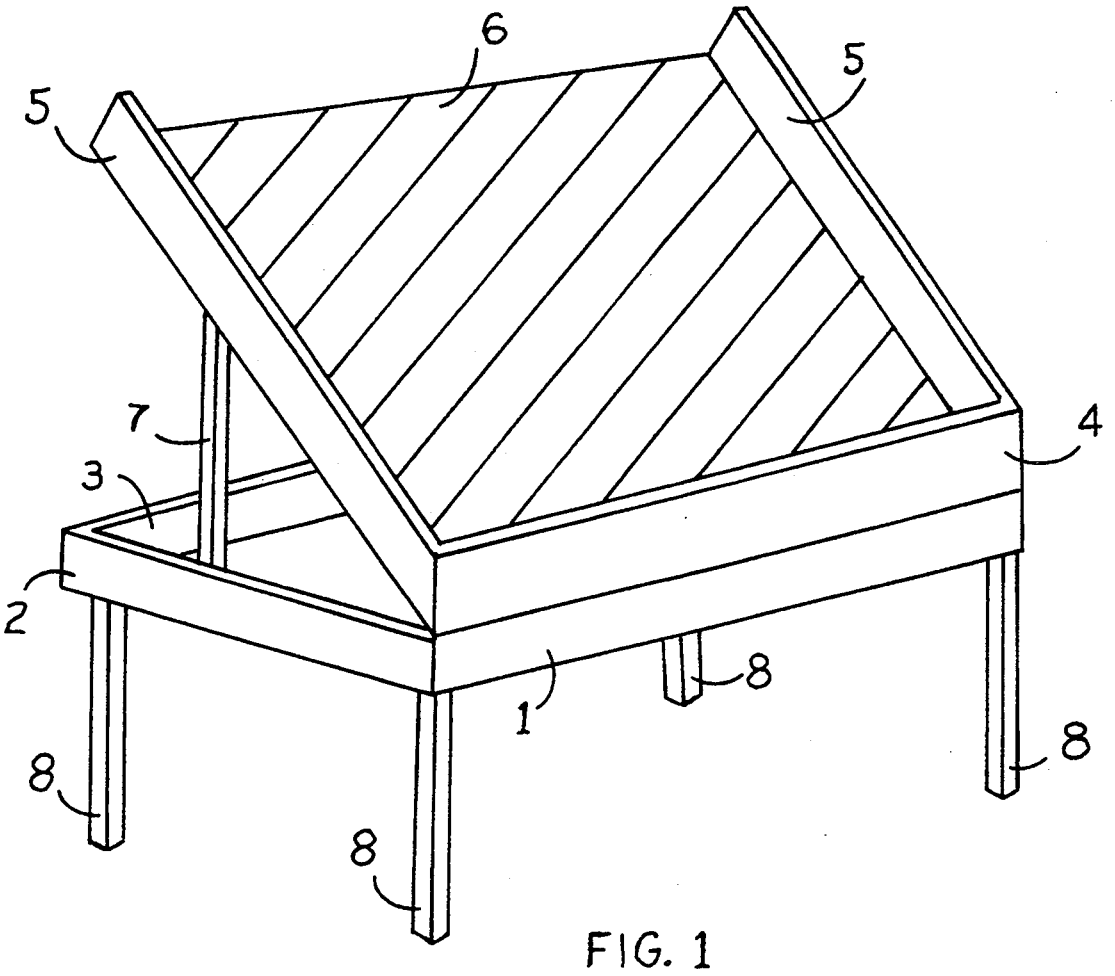
FIG. 1 shows an adjustable rack of the present invention.

FIG. 1 shows an adjustable rack of the present invention. In FIG. 1, a bottom frame is defined by a front member, 1, a pair of side members, 2, and a rear member, 3. Pivotally attached to the front member of the frame is a bin suitable for holding merchandise. The bin is defined by a front wall, 4, a pair of side walls, 5, and a floor, 6. The bin can pivot between two extremes. In one extreme the floor can be substantially parallel to the bottom frame. In the other extreme the floor can be substantially perpendicular to the bottom frame. Attached to the rearward portion of the bottom frame and the rearward portion of the bin is at least one adjustable support member, 7, suitable for maintaining a predetermined angle between the floor of the bin and the bottom frame. A multiplicity of legs, 8, are optionally attached to the bottom frame.

Figure 2:
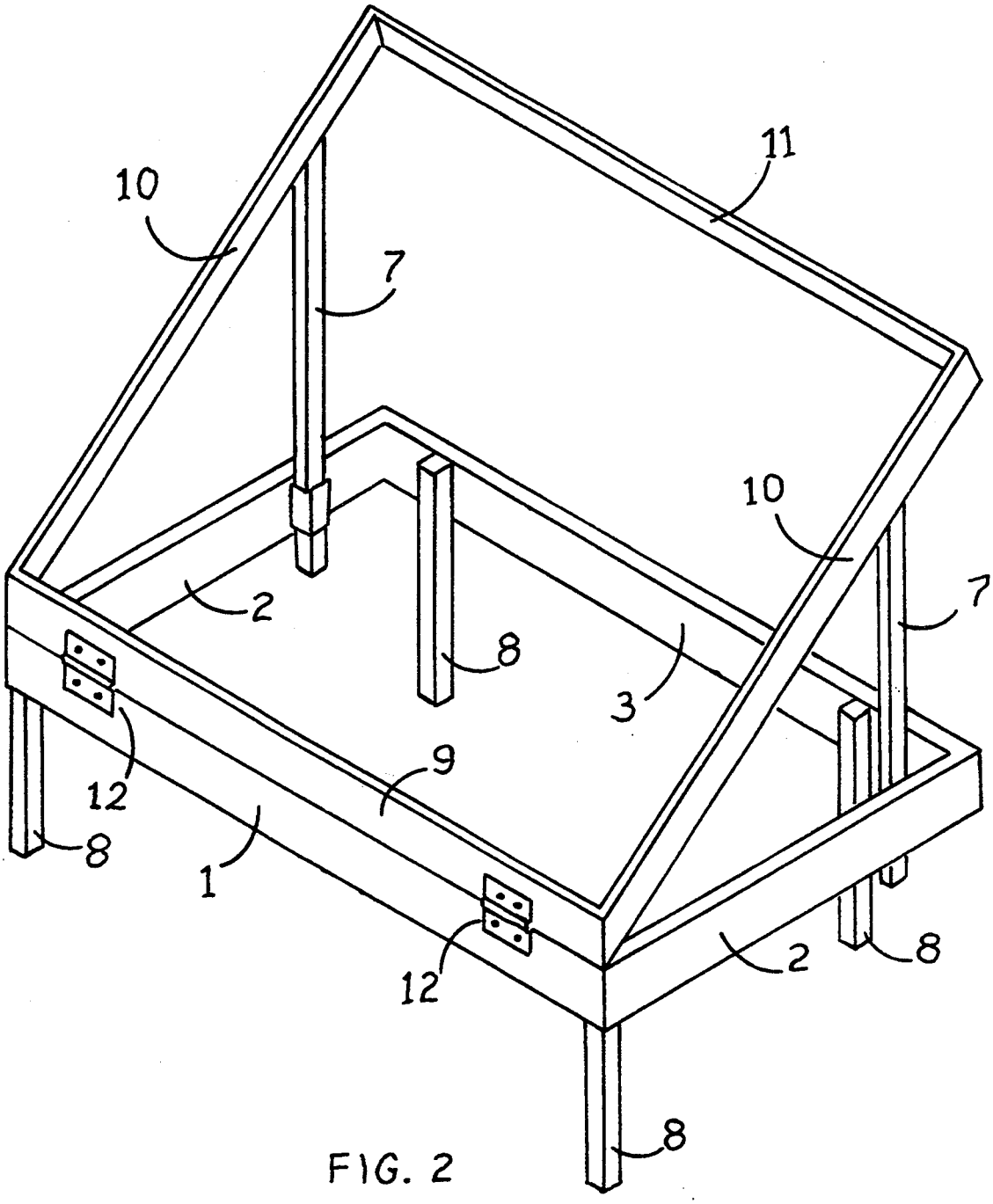
FIG. 2 shows a cutaway view of one embodiment of the frame members of the present invention.

FIG. 2 shows a cutaway view of one embodiment of the present invention. In FIG. 2 the bin floor and walls are not shown. The bottom frame, legs and adjustable support members are similar to similarly numbered elements in FIG. 1. A bin frame, comprising front bin frame member, 9, a pair of side bin frame members, 10 and a back bin frame member, 11, is pivotally attached to the front member, 1, by a pair of hinges, 12. The rearward portion of the bin frame is connected to the rearward portion of the bottom frame by a pair of adjustable support members, 7.

Figure 3:
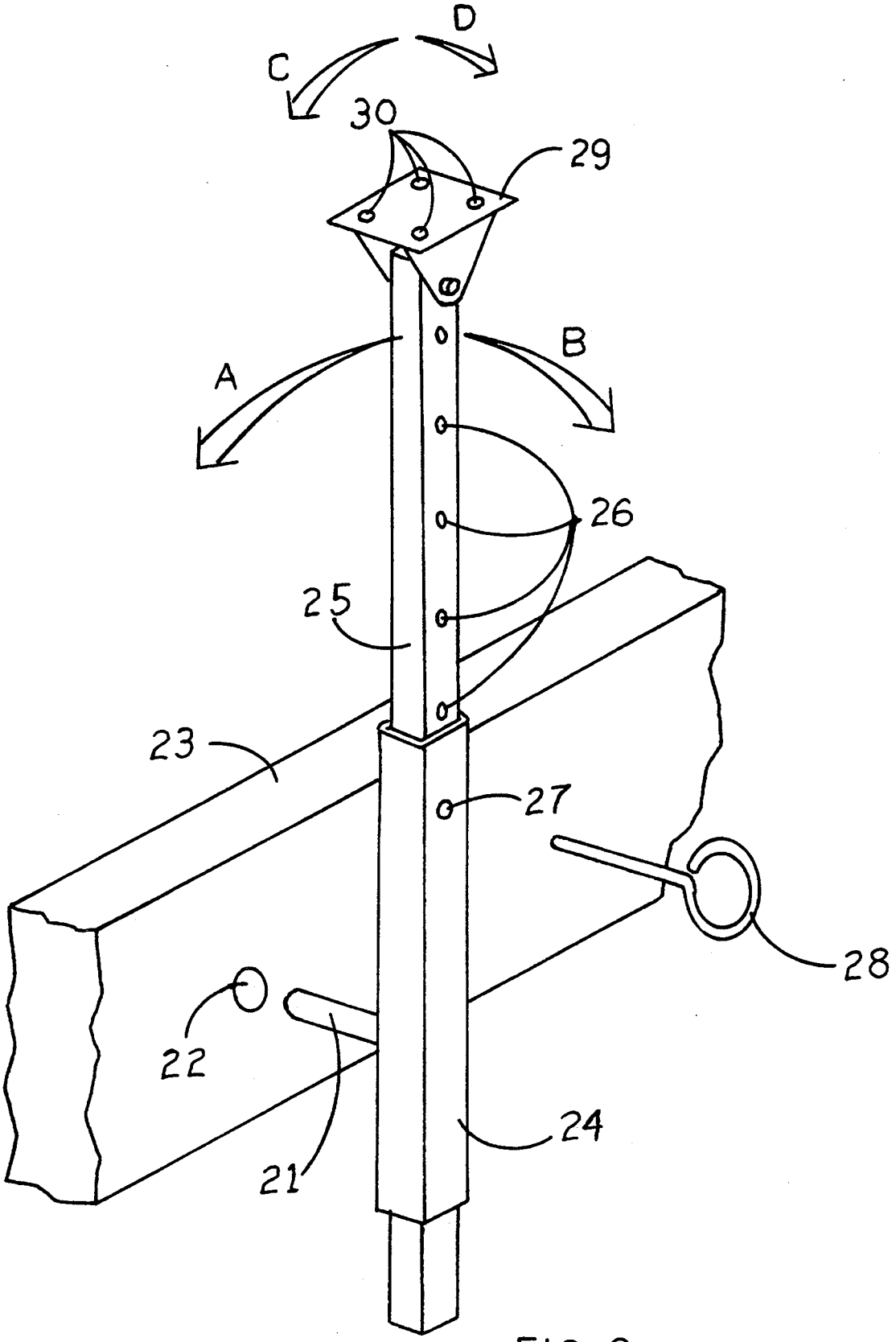
FIG. 3 shows an embodiment of an adjustable support member of the present invention.

FIG. 3 shows one embodiment of an adjustable support member of the present invention. The adjustable support member comprises a finger, 21, suitable for mating with a substantially round void, 22, in a bottom frame member, 23. Rigidly attached to the finger, 21, is a tube, 24, capable of accepting a discrete sliding member, 25, therein. The discrete sliding member, 25, comprises a multiplicity of adjustment holes, 26, each of which are capable of aligning with a tube hole, 27, in the tube, 24. To change the length of the adjustable support member, a predetermined adjustment hole, 26, is aligned with the tube hole, 27, and a pin, 28, is inserted through the pair of aligned holes. The upper extent of the discrete sliding member comprises a mounting bracket, 29, rotatably mounted to the discrete sliding member on an axle, 30. The mounting bracket, 29, preferably comprises a multiplicity of mounting holes, 31, for attachment to the bin. One advantage offered with the present invention is the simplicity of operation and the rigidity of the adjustable support member. The adjustable support member can rotate on the axis defined by the finger, 21, as shown by the arrows A and B. The mounting bracket, 29, is also capable of rotating on the axis defined by the axle, 30 as shown by the arrows C and D. As the adjustable support member is lengthened the entire adjustable support member rotates on the axis defined by the finger, 21, in the direction of arrow A and the mounting bracket, 29, rotates on the axis defined by the axle, 30, in the direction of arrow C. It would be apparent to one skilled in the art that this allows the entire bin to be raised and lowered with minimal manipulation since the only part of the adjustable support member which must be manipulated is the pin, 28.

Figure 4:
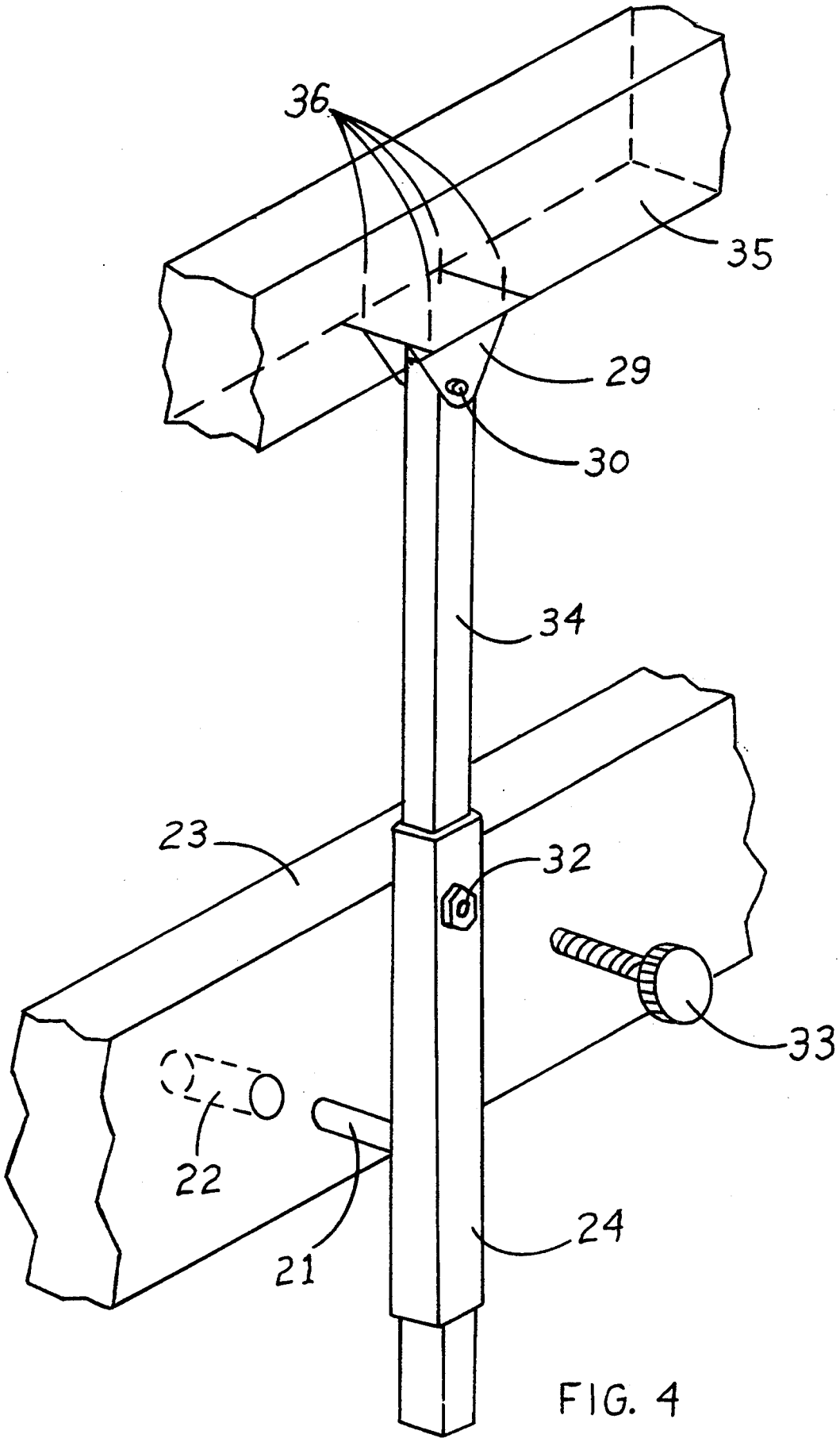
FIG. 4 shows another embodiment of an adjustable support member of the present invention.

FIG. 4 shows another embodiment of the adjustable support member. In FIG. 4 the finger, 21, substantially round void, 22, bottom frame member, 23, tube, 24, mounting bracket, 29 and axle, 30, are similar to the similarly numbered elements in FIG. 3. The tube, 24, comprises a threaded hole, 32. A similarly threaded pin, 33, mates with the threaded hole to abut against the continuously adjustable sliding member, 34, and retain the continuously adjustable sliding member in place. The length of the adjustable support member can be altered by twisting the threaded pin, 33, until it sufficiently disengages with the continuously adjustable sliding member to allow free movement of the continuously adjustable member within the tube. The continuously adjustable sliding member is then moved to the desired position in the tube, the threaded pin is then twisted to abut against the continuously adjustable sliding member. The mounting bracket, 29, is secured to a bin member, 35, by attachment means, 36, such as glue, screws, nails, bolts and the like.

Figure 5:
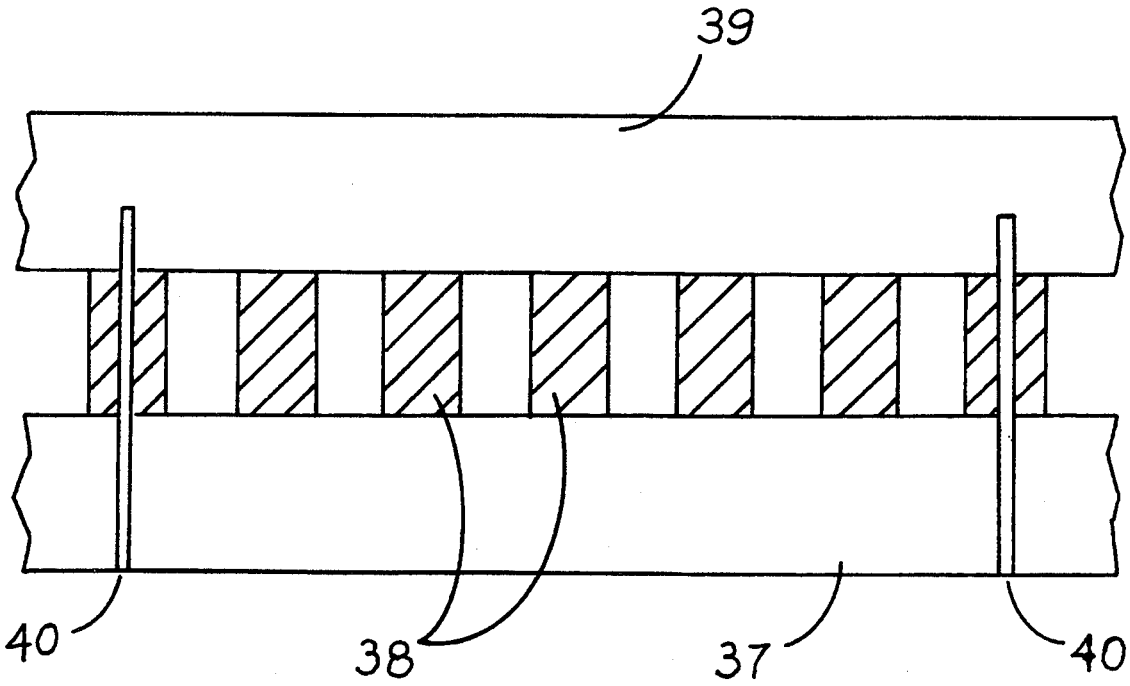
FIG. 5 shows a partial side view of one embodiment of bin construction in the present invention.

FIG. 5 shows a partial side view of a preferred embodiment of the bin of the present invention. The bin comprises a frame element, 37, with a multiplicity of floor joist elements, 38, attached thereabove. The wall element, 39, is attached to the top of the bin by a multiplicity of attachment means, 40, such as screws, nails, bolts and the like. The floor joist elements may be attached to the frame element by glue, screws, nails, or any similar attachment means known to the art.

Figure 6:
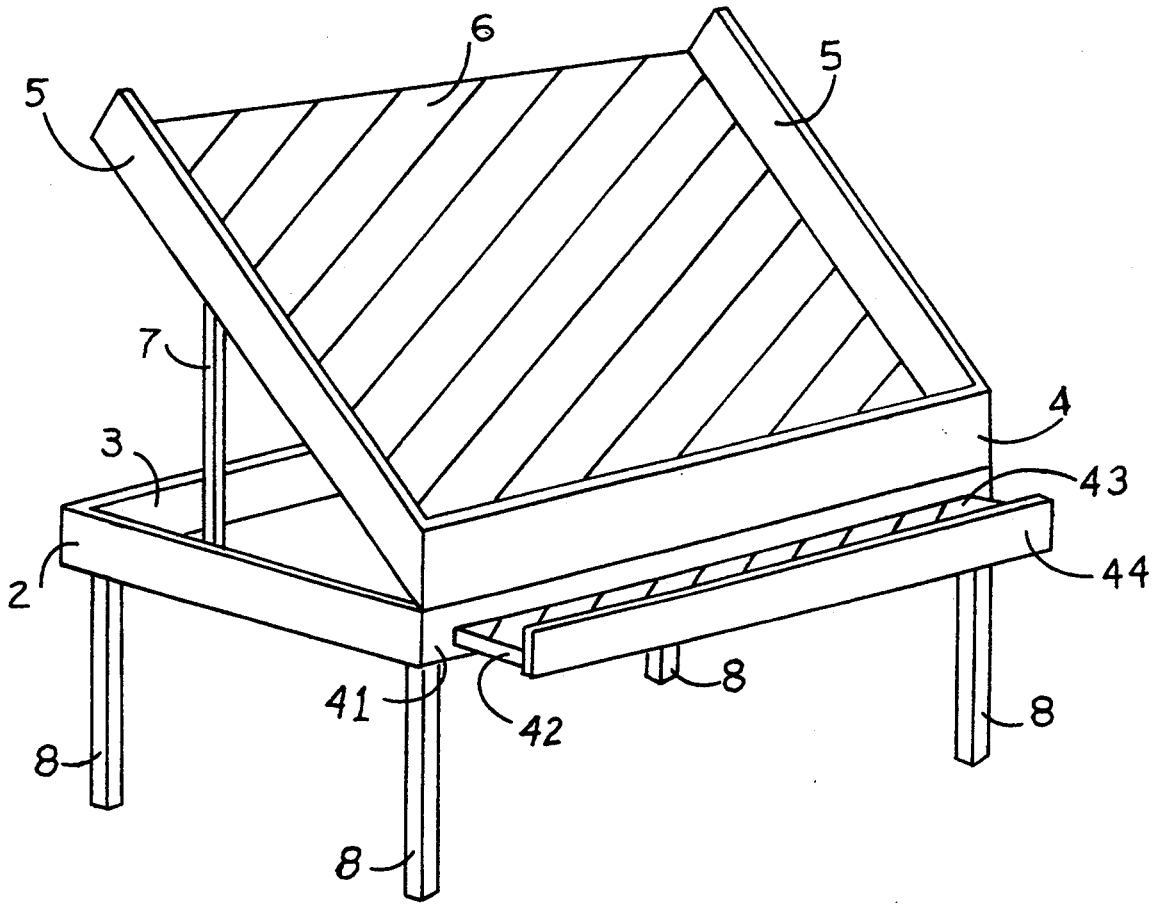
FIG. 6 shows an embodiment of the present invention further comprising a drawer.

FIG. 6 shows an embodiment of the present invention wherein the elements similar to those of FIG. 1 are numbered accordingly. A shelf is slidably attached to the slotted front member, 41, of the bottom frame. The shelf comprises a shelf frame member, 42, shelf floor, 43, and front wall, 44. The shelf is attached to the front member of the bottom frame with drawer brackets (not shown) as known in the art.

The overall shape of the produce table is preferably rectangular or square. Other shapes are considered within the teachings of the present invention including triangular, semicircular, or multifaceted such as expected from half of a hexagon, octagon or the like. The bottom frame and bin may be the same shape or they may be of a different shape. Limitations on the combinations of shapes available would be apparent to one skilled in the art yet the constraints to be considered are limited to those combinations which allow for a pivotal attachment at the front and a suitable mounting position for the adjustable support member in the rearward portion of the produce stand.

The bottom frame is preferably a rectangle, or square, as illustrated in the drawings. Also considered within the teachings of the present invention are frames which are shaped substantially like the letter "H". While four sides are preferred it is considered within the teachings to employ a three sided frame and in fact this may be so preferred if weight is a concern for the intended application. The bottom frame members may be constructed from wood, metal, plastic, hardened resin, graphite and the like and the members may be secured one to the other in any conventional method including, nails, screws, bolts, glue, weld, rivet, framing brackets, or by common joining techniques such as rabbet joints, tongue and groove and the like, as known in the art.

The bin configuration is preferably rectangular or square, as described above, yet other shapes are considered within the teachings of the present invention. The bin may comprise a frame such as that illustrated in FIG. 2 with a floor and sides attached thereto. The bin may also comprise a floor element with the walls, adjustable support member, and pivotal attachment means attached directly to the floor. In this embodiment the floor member acts as the support frame and should be of sufficient strength to provide rigidity to the bin. A particularly preferred embodiment comprises a bin frame, substantially as illustrated in FIG. 2, with a multiplicity of substantially parallel slats attached to the bin frame as illustrated in FIG. 5. Walls are then attached to either the sides of the bin frame (not illustrated) or to the top of the slats as shown in FIG. 5. This embodiment is particularly preferred since water can be applied to the contents of the bin and the excess water will drop directly below the stand. The bin preferably comprises at least one wall to insure that contents do not fall out of the bin. It is most preferred that the one wall be on the same side of the bin as the pivotal connection to the bottom frame. Up to four outer walls may be employed as would be readily realized by one skilled in the art. It would also be realized to one skilled in the art to include a multiplicity of walls within the outer walls to define compartments within which various items could be placed for display.

It is preferable, but not necessary, for the produce stand to have a multiplicity of legs. It is most preferable that the length of the legs be adjustable as known in the art and it is most preferred that the legs have wheels in which the rotation of the wheels are capable of being locked and released as known in the art.

The bin is pivotally mounted to the front member of the bottom frame. The pivotal mount is preferably a hinge. Any conventional hinge known to the art is considered within the teachings of the present invention. A single hinge may be employed as well as a multiplicity of hinges.

The finger may be unthreaded or threaded and preferably extends through the bottom frame member. To insure that the finger does not become dislodged from the bottom frame member a keeper is preferred such as a "C" shaped spring in a slot of the finger, a cotter pin, a threaded nut and the like.

The tube may be substantially square, substantially round or any other shape commonly employed for tubes. It is most preferred that the tube and sliding member are substantially of the same shape.

The sliding member may slide on the inside of the tube, as illustrated in the drawings, or it may slide on the outside of the tube. If the sliding member slides on the outside of the tube it is most preferably that the cross-section of the sliding member be shaped substantially like the letter "C" to allow the finger to traverse the open side of the sliding member. It would be apparent to one skilled in the art that the tube may be solid when the sliding member is exterior thereto and that the sliding member may be solid when the tube is exterior thereto. The holes in the sliding member and tube preferably align at various increments and the inserted pin maintains the alignment. The pin may go completely through the tube and sliding member or it may stop within the interior of the inner member.

A threaded pin may be employed with, or without, associated holes in the sliding member. When the sliding member is exterior to the tube the threaded hole may be integral to the sliding member.

Drawer brackets are well known in the art and many varieties are commercially available and suitable for the invention described herein. Most desirable is a drawer bracket which comprises a pair of tracks mounted to both the drawer and the frame wherein the tracks are capable of sliding one in the other.

I claim:

1. An adjustable display rack comprising:

a bottom frame comprising a front end and a rear end;

a bin pivotally mounted to said front end of said bottom frame;

at least one adjustable support rotatably mounted to said frame;

wherein said adjustable support comprises:

a tube;

an elongated member slidably mounted to said tube;

a locking element for reversibly fixing the position of said elongated member relative to said tube;

a mounting bracket pivotally attached to one end of said elongated member;

wherein said mounting bracket is rigidly attached to said bin.

2. The adjustable display rack recited in claim 1 wherein said adjustable display rack further comprises legs.

3. The adjustable display rack recited in claim 1 wherein said elongated member comprises a multiplicity of holes wherein each said hole is independently capable of aligning with a tube hole in said tube and said adjustable support further comprises a pin inserted in one of said hole and said tube hole.

4. The adjustable display rack recited in claim 3 wherein said tube hole and said pin comprise threads.

5. The adjustable display rack recited in claim 1 further comprising a drawer.

6. The adjustable display rack recited in claim 1 wherein the shape of said bottom frame is chosen from the set consisting of rectangular, square and triangular.

7. The adjustable display rack recited in claim 1 wherein said bin comprises a floor and at least one wall.

8. The adjustable display rack recited in claim 7 wherein said bin comprises a multiplicity of walls.

9. The adjustable display rack recited in claim 1 wherein said bin comprises:

a rectangular frame;

a plurality of parallel slats secured to said frame;

at least one wall secured to said parallel slats.

10. The adjustable display rack recited in claim 1 wherein said bin comprises a floor with at least one wall attached thereto.

11. The adjustable display rack recited in claim 1 wherein said bin is pivotally mounted to said bottom frame with at least one hinge.

12. The adjustable display rack recited in claim 11 wherein said bin is pivotally mounted to said bottom frame with a plurality of hinges.

13. The adjustable display rack recited in claim 1 wherein said bottom frame is metal.

14. The adjustable display rack recited in claim 1 wherein said bin is wood.

* * * * *